US011644775B2

(12) United States Patent
Ishihara et al.

(10) Patent No.: US 11,644,775 B2
(45) Date of Patent: May 9, 2023

(54) HEATING DEVICE WITH HEATING ROLLER HAVING RESISTANCE HEAT-GENERATING LAYER AND HEATING-TARGET USING APPARATUS

(71) Applicant: FUJIFILM Business Innovation Corp., Tokyo (JP)

(72) Inventors: Takuma Ishihara, Kanagawa (JP); Takashi Ohashi, Kanagawa (JP); Takashi Matsubara, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/462,317

(22) Filed: Aug. 31, 2021

(65) Prior Publication Data

US 2022/0373948 A1 Nov. 24, 2022

(30) Foreign Application Priority Data

May 21, 2021 (JP) ..... JP2021-085908

(51) Int. Cl.
*G03G 15/20* (2006.01)

(52) U.S. Cl.
CPC ..... *G03G 15/2057* (2013.01); *G03G 15/2064* (2013.01); *G03G 2215/2038* (2013.01)

(58) Field of Classification Search
USPC ..... 399/328
See application file for complete search history.

(56) References Cited

U.S. PATENT DOCUMENTS

| | | | | |
|---|---|---|---|---|
| 10,216,130 | B2 | 2/2019 | Imaizumi et al. | |
| 2017/0343929 | A1* | 11/2017 | Narahara | G03G 15/206 |
| 2018/0173140 | A1* | 6/2018 | Imaizumi | G03G 15/2057 |
| 2019/0235422 | A1* | 8/2019 | Yabuki | G03G 15/2053 |
| 2020/0012219 | A1* | 1/2020 | Oomoto | G03G 15/2064 |

FOREIGN PATENT DOCUMENTS

| | | | |
|---|---|---|---|
| JP | 2013-142834 | A | 7/2013 |
| JP | 2017-10020 | A | 1/2017 |

* cited by examiner

*Primary Examiner* — Quana Grainger
(74) *Attorney, Agent, or Firm* — Sughrue Mion, PLLC

(57) ABSTRACT

A heating device includes a heating roller having a resistance heat-generating layer that generates heat by passage of a current through the resistance heat-generating layer, a support member that supports a treatment portion in which a heating treatment is performed, a belt that is stretched between at least the heating roller and the support member and that rotates, and a pressure rotating body that rotates in such a manner as to press a sheet-shaped heating target that is an object to be subjected to a heating treatment against the treatment portion including an outer peripheral surface portion of the belt that is supported by the support member and in such a manner as to cause the heating target to pass through the treatment portion. The heating roller is not equipped with a power receiving component configured to receive a rotational power that is transmitted.

9 Claims, 7 Drawing Sheets

HEATING DEVICE WITH HEATING ROLLER HAVING RESISTANCE HEAT-GENERATING LAYER AND HEATING-TARGET USING APPARATUS

CROSS-REFERENCE TO RELATED APPLICATIONS

This application is based on and claims priority under 35 USC 119 from Japanese Patent Application No. 2021-085908 filed May 21, 2021.

BACKGROUND

(i) Technical Field

The present disclosure relates to a heating device and a heating-target using apparatus.

(ii) Related Art

Japanese Unexamined Patent Application Publication No. 2017-10020 (claim 25, FIG. 1 to FIG. 3, and so forth) describes a fixing device that fixes an image onto a recording material. The fixing device includes a heat rotating body that has a heat generating layer and a pressing member that forms a nip part with the heat rotating body. The heat rotating body has a plurality of low-resistance layers formed on a region of the heat generating layer in which the recording material is transported, the low-resistance layers being arranged in such a manner as to be spaced apart from each other in the longitudinal direction so that they do not come into contact with each other. The plurality of low-resistance layers are each a layer that has a volume resistance value lower than that of the heat generating layer and extends in a circumferential direction of the heat generating layer.

Japanese Unexamined Patent Application Publication No. 2013-142834 (claim 1, FIG. 1, and so forth) describes a heat-generating fixing roller having a resistance heat-generating element that is provided on the inner peripheral surface of a cylindrical core bar with an electrical insulating layer interposed therebetween. The electrical insulating layer is made of a water-repellent resin, and the core bar, the electrical insulating layer, and the resistance heat-generating element are arranged in such a manner as to be in close contact with one another.

SUMMARY

Aspects of non-limiting embodiments of the present disclosure relate to providing a heating device and a heating-target using apparatus that are capable of suppressing asymmetric and uneven distribution of temperature in a heating roller, which has a resistance heat-generating layer, in an axial direction of the heating roller compared with the case where a power receiving component that receives a rotational power to be transmitted to the heating roller is mounted on the heating roller or the case where a complementary component that has a heat capacity approximately equal to that of the power receiving component is not mounted on the heating roller.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a heating device including a heating roller having a resistance heat-generating layer that generates heat by passage of a current through the resistance heat-generating layer, a support member that supports a treatment portion in which a heating treatment is performed, a belt that is stretched between at least the heating roller and the support member and that rotates, and a pressure rotating body that rotates in such a manner as to press a sheet-shaped heating target that is an object to be subjected to a heating treatment against the treatment portion including an outer peripheral surface portion of the belt that is supported by the support member and in such a manner as to cause the heating target to pass through the treatment portion, wherein the heating roller is not equipped with a power receiving component configured to receive a rotational power that is transmitted.

BRIEF DESCRIPTION OF THE DRAWINGS

Exemplary embodiments of the present disclosure will be described in detail based on the following figures, wherein.

DETAILED DESCRIPTION

Exemplary embodiments of the present disclosure will be described below with reference to the drawings.

First Exemplary Embodiment

Figure 1:
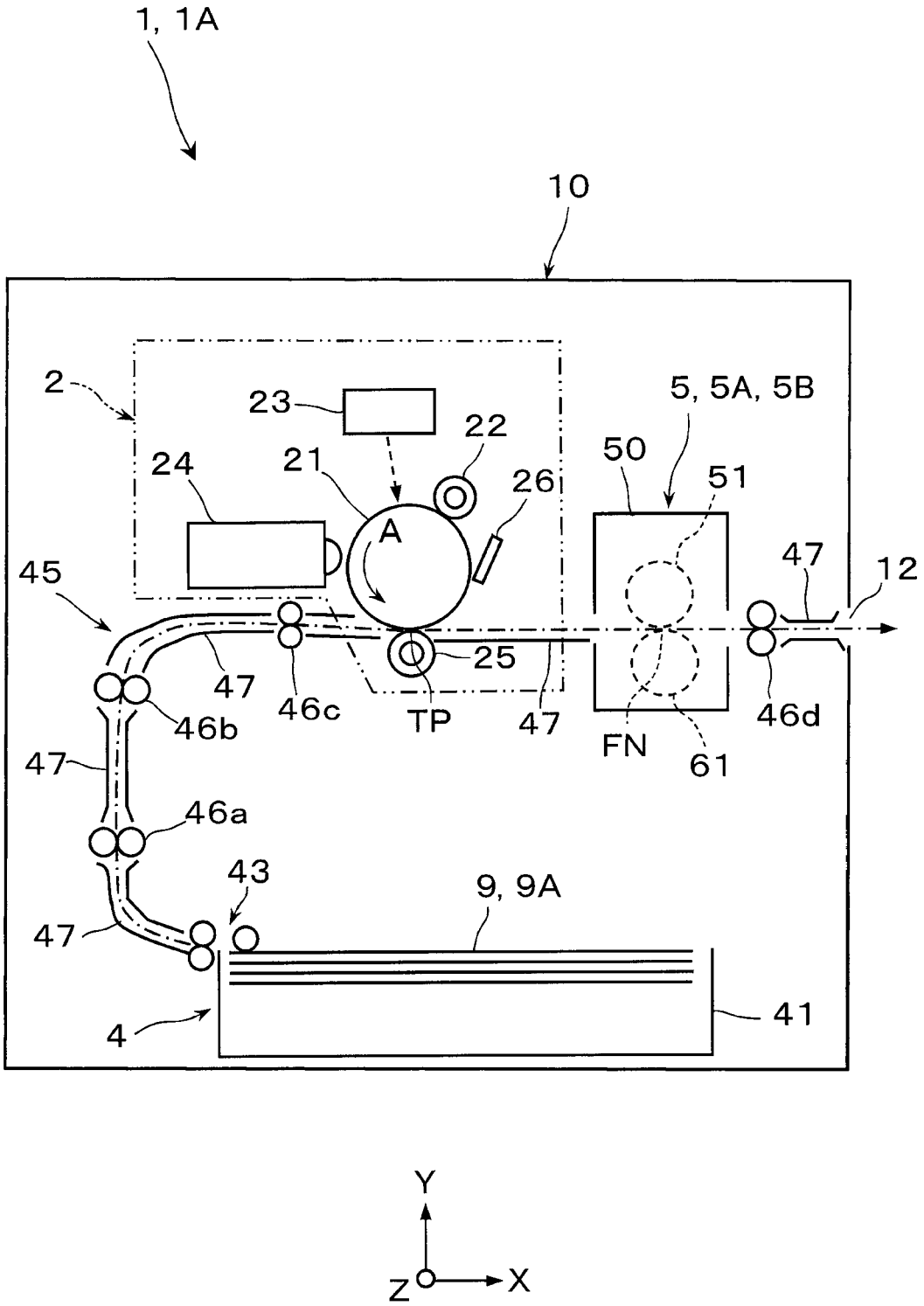
FIG. 1 is a schematic diagram of an image forming apparatus according to a first exemplary embodiment, which is an example of a heating-target using apparatus.
Figure 2:
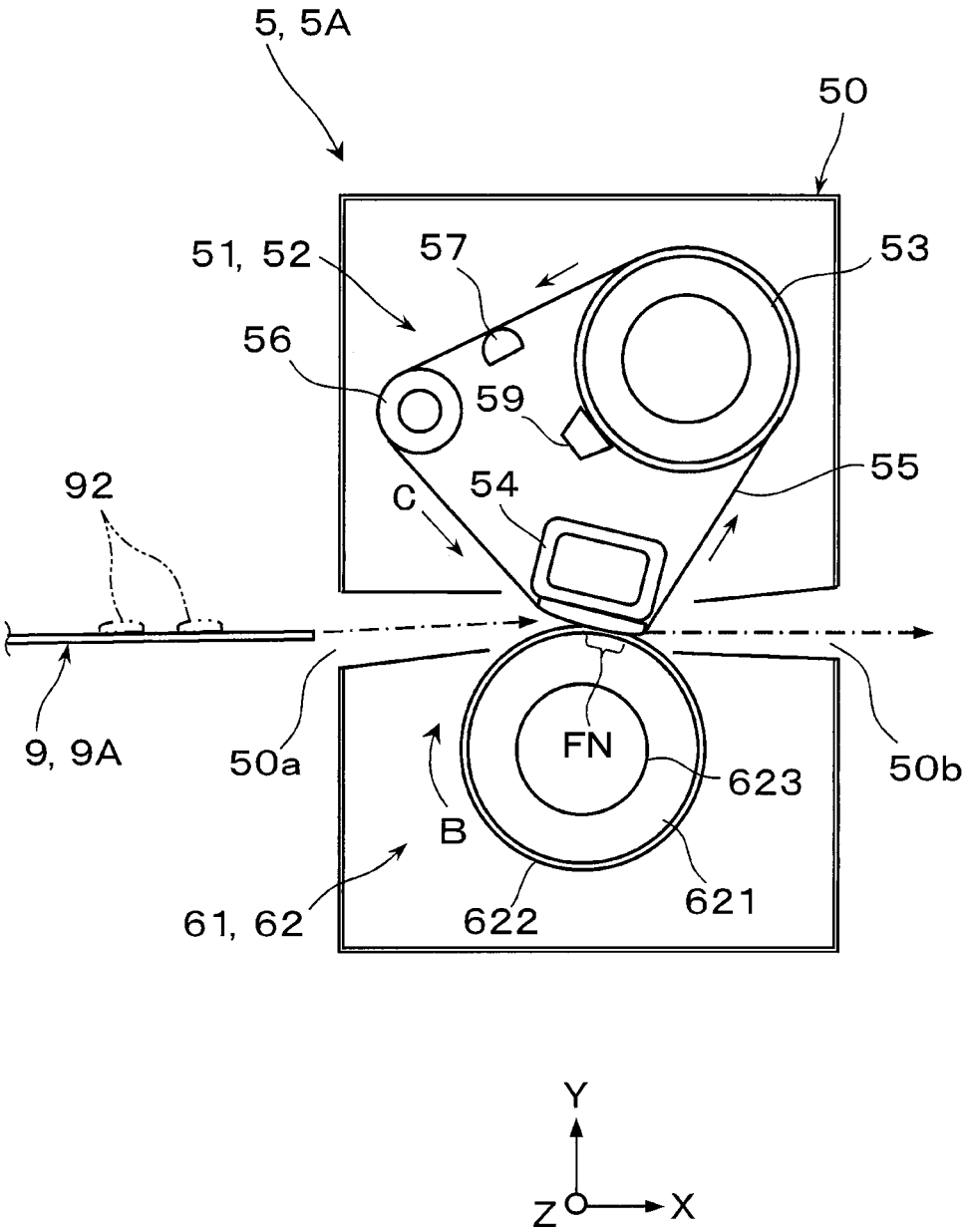
FIG. 2 is a schematic diagram of a fixing device according to the first exemplary embodiment, which is an example of a heating device.

FIG. 1 illustrates an image forming apparatus 1A according to the first exemplary embodiment, which is an example of a heating-target using apparatus 1. FIG. 2 illustrates a fixing device 5A according to the first exemplary embodiment, which is an example of a heating device 5.

The heating-target using apparatus 1 is an apparatus that uses a sheet-shaped object 9 that is to be heated (hereinafter referred to as "heating target 9"). The heating device 5 is a device that at least heats the sheet-shaped heating target 9.

In the following description, the direction indicated by arrow X, the direction indicated by arrow Y, and the direction indicated by arrow Z in the drawings respectively correspond to a width direction of the apparatus, a height direction of the apparatus, and a depth direction of the apparatus that is perpendicular to both the width direction and the height direction. In the drawings, a circle mark at the intersection of arrow X and arrow Z indicates that arrow Z corresponding to the depth direction of the apparatus points in a downward direction perpendicular to the plane in each of the drawings.

<Heating-Target Using Apparatus>

The image forming apparatus 1A, which is an example of the heating-target using apparatus 1, forms an image by heating one of recording media 9A on which an image has been formed with powder developer. Each of the recording media 9A is an example of the sheet-shaped heating target 9.

As illustrated in FIG. 1, the image forming apparatus 1A includes a housing 10 having a desired external shape, and an image forming device 2, a medium supply device 4, a medium transport device 45, a fixing device 5A, and so forth are arranged in the internal space of the housing 10. In FIG. 1, a transport path along which the recording media 9A are transported by the medium transport device 45 in the housing 10 is indicated by a one-dot chain line.

The image forming device 2 is a device that forms a toner image by using a toner, which functions as a developer, and transfers the toner image onto one of the recording media 9A. The image forming device 2 is configured as, for example, a device that employs an image forming system such as an electrophotographic system, and in the image forming device 2, units such as a charging unit 22, an exposure unit 23, a developing unit 24, a transfer unit 25, and a cleaning unit 26 are arranged around a photoconductor drum 21 that rotates in the direction indicated by arrow A.

The photoconductor drum 21 is an example of an image holding unit and is a drum-shaped photoconductor having a photosensitive layer that serves as an image forming surface and as an image holding surface. The charging unit 22 is a unit that charges the outer peripheral surface (the image forming surface) of the photoconductor drum 21 to a required surface potential. For example, the charging unit 22 includes a charging member that has, for example, a roll-like shape, and the charging member is brought into contact with the outer peripheral surface (the image forming surface) of the photoconductor drum 21 and is supplied with a charging current.

The exposure unit 23 is a unit that exposes the outer peripheral surface of the photoconductor drum 21, which has been charged, to light on the basis of image information so as to form an electrostatic latent image. The exposure unit 23 operates in response to receiving an image signal that is generated as a result of an image processing unit or the like (not illustrated) performing a required processing operation on image information input from the outside. The image information is, for example, information relating to an image to be formed such as a character, a figure, a photograph, or a pattern. The developing unit 24 is a unit that develops an electrostatic latent image formed on the outer peripheral surface of the photoconductor drum 21 into a visible monochromatic color toner image with a developer (a toner) of a corresponding predetermined color (e.g., black).

The transfer unit 25 is a unit that electrostatically transfers a toner image formed on the outer peripheral surface of the photoconductor drum 21 onto one of the recording media 9A. The transfer unit 25 includes a transfer member that has, for example, a roll-like shape, and the transfer member is brought into contact with the outer peripheral surface of the photoconductor drum 21 and is supplied with a transfer current. The cleaning unit 26 is a unit that cleans the outer peripheral surface of the photoconductor drum 21 by removing unwanted substances such as undesirable toner and paper dust deposited on the outer peripheral surface of the photoconductor drum 21.

In the image forming device 2, a portion where the photoconductor drum 21 and the transfer unit 25 face each other corresponds to a transfer position TP at which transfer of a toner image is performed.

The medium supply device 4 is a device that accommodates and sends out the recording media 9A each of which is to be supplied to the transfer position TP in the image forming device 2. The medium supply device 4 includes units such as one or more accommodating units 41 in which the recording media 9A are accommodated and one or more delivery units 43 that send out the recording media 9A one by one.

The recording media 9A may be sheet-shaped recording media that are capable of being transported by the medium transport device 45 in the housing 10 and onto which toner images are transferable and thermally fixable, and the material, the form, and so forth of the recording media 9A are not particularly limited. In the image forming apparatus 1A, a recording medium such as a normal sheet, a coated sheet, a film, a piece of foil, a piece of sheet-shaped cloth that is cut to have a predetermined size or a recording medium such as an envelope is used as each of the recording media 9A.

The medium transport device 45 is a device that is an example of a transport unit configured to transport the heating target 9 such as one of the recording media 9A, and in the image forming apparatus 1A, the medium transport device 45 is configured as a device that transports each of the recording media 9A to a predetermined position in the housing 10.

The medium transport device 45 is disposed in the housing 10 in such a manner that a supply path along which the recording media 9A are transported from the medium supply device 4 to the transfer position TP in the image forming device 2, a relay path along which the recording media 9A are transported from the transfer position TP in the image forming device 2 to the fixing device 5A, an ejection path along which the recording media 9A are transported from the fixing device 5A to an ejection port 12, which is formed in, for example, a side surface portion of the housing 10, and so forth are formed. More specifically, the medium transport device 45 is formed by arranging a required number of pairs of transport rollers 46 (46*a* to 46*d*) and a required number of guide path members 47 at predetermined positions. The pairs of transport rollers 46 are each configured to transport each of the recording media 9A by nipping the recording medium 9A therebetween, and the guide path members 47 form a transport space or the like that guides the recording media 9A destination.

The fixing device 5A, which is an example of the heating device 5, is a device that performs heat and pressure treatments in order to fix a toner image, which is an unfixed image that has been transferred to one of the recording media 9A at the transfer position TP in the image forming device 2, onto the recording medium 9A. The fixing device 5A is formed by arranging units such as a heat rotating body 51 and a pressure rotating body 61 in an internal space of a housing 50 that has an introduction port 50*a* and an ejection port 50*b* for the recording media 9A.

In addition, in the fixing device 5A, as illustrated in FIG. 1 and FIG. 2, the heat rotating body 51 and the pressure rotating body 61 are arranged so as to rotate while being in contact with each other. The portion in which the heat rotating body 51 and the pressure rotating body 61 are in contact with each other is configured as a fixing treatment portion FN in which heat and pressure are applied to one of the recording media 9A and a toner image that pass through the fixing treatment portion FN.

Details of the fixing device 5A will be described later.

In the image forming apparatus 1A, for example, image formation is performed in the following manner.

In the image forming apparatus 1A, in response to a control unit (not illustrated) receiving a command for an image forming operation, in the image forming device 2, a charging operation, an exposure operation, a developing operation, and a transfer operation are performed. Meanwhile, the medium supply device 4 sends out a desired one of the recording media 9A, and the recording medium 9A is transported along the supply path of the medium transport device 45 and fed to the transfer position TP.

As a result, a toner image is formed on the photoconductor drum 21 in accordance with image information, and the toner image is transferred onto the recording medium 9A fed to the transfer position TP from the medium supply device 4 by the medium transport device 45. In this case, the recording medium 9A to which the toner image has been transferred is separated from the photoconductor drum 21, which is rotating, while being nipped between the photoconductor drum 21 and the transfer unit 25 and then transported toward the heating device 5 along the relay path of the medium transport device 45.

Subsequently, in the fixing device 5A of the image forming apparatus 1A, when one of the recording media 9A to which toner images 92 have been transferred is introduced into the fixing treatment portion FN, in which the heat rotating body 51 and the pressure rotating body 61 are in contact with each other, so as to pass through the fixing treatment portion FN as illustrated in FIG. 2, a fixing operation is performed. As a result, in the fixing device 5A, the unfixed toner images 92 on the recording medium 9A are heated under pressure, and the toner images 92 melt and are fixed onto the recording medium 9A.

The recording medium 9A to which the toner images 92 have been fixed is ejected from the housing 50 while being nipped between the heat rotating body 51 and the pressure rotating body 61 in the fixing device 5A and then transported along the ejection path of the medium transport device 45 to the ejection port 12. Finally, the recording medium 9A is sent out by the transport rollers 46*d* and accommodated in an ejected-sheet-accommodating unit (not illustrated) that is formed in a portion of the housing 10.

By performing the above series of operations, a basic image forming operation for forming a monochromatic image onto a surface of one of the recording media 9A is completed.

<Heating Device>

The fixing device 5A will now be described in detail.

Figure 3:
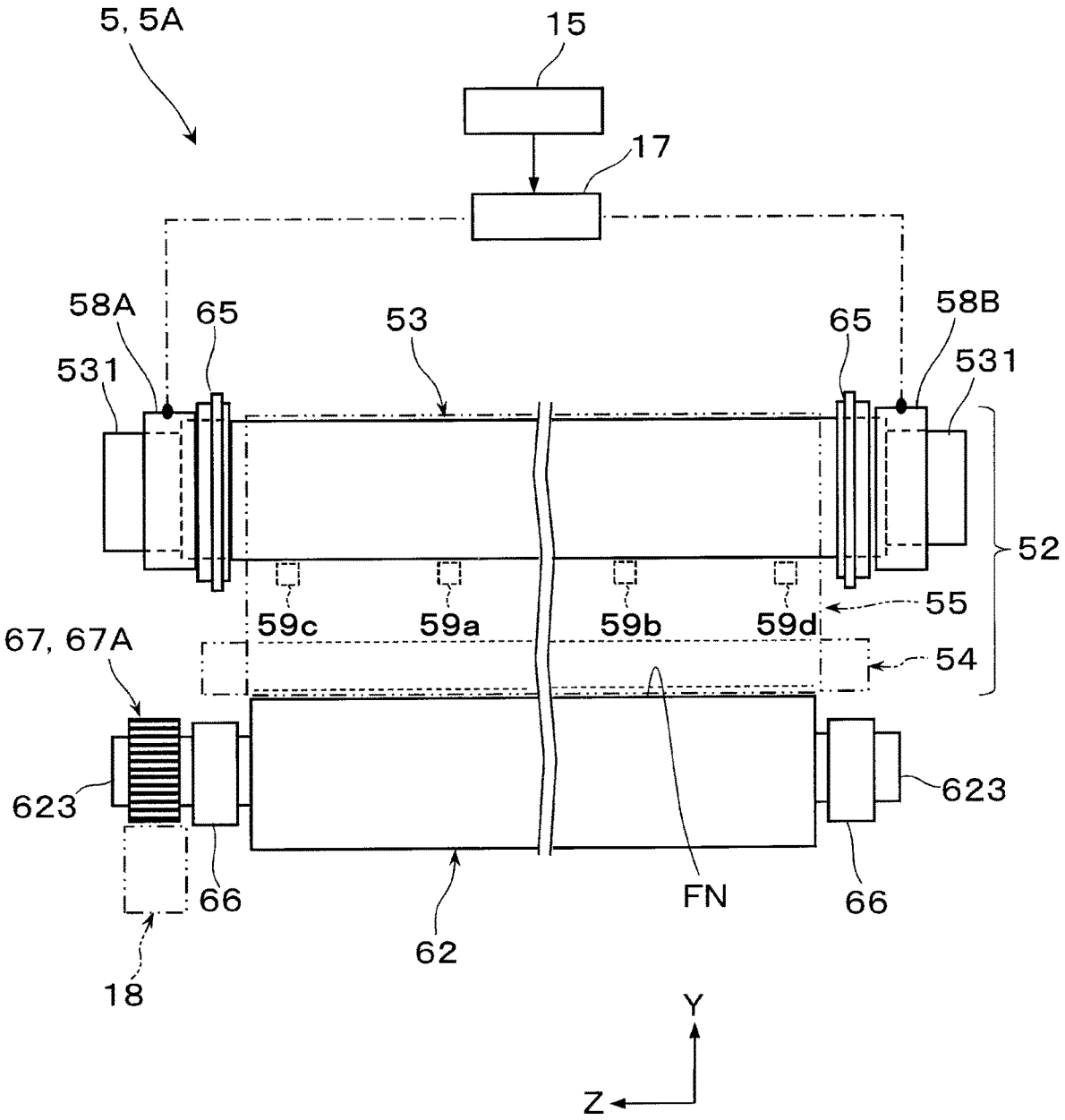
FIG. 3 is a schematic diagram illustrating a portion of the fixing device illustrated in FIG. 2.

As illustrated in FIG. 2, FIG. 3, and the like, the fixing device 5A according to the first exemplary embodiment uses a belt-nip-type heating unit 52 as the above-mentioned heat rotating body 51 and a pressure roller 62 having a roll-like shape as the above-mentioned pressure rotating body 61.

The heating unit 52 includes a heating roller 53, a support member 54, a fixing belt 55, an adjustment support roller 56, and so forth that are integrated with one another.

Figure 4A:
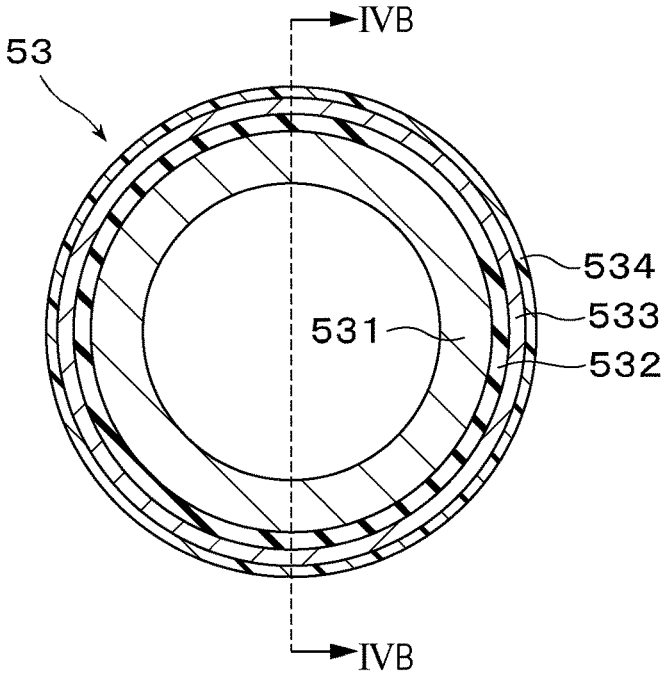
FIG. 4A and FIG. 4B are respectively a schematic cross-sectional view of a heating roller and a schematic cross-sectional view taken along line IVB-IVB of FIG. 4A.
Figure 4B:
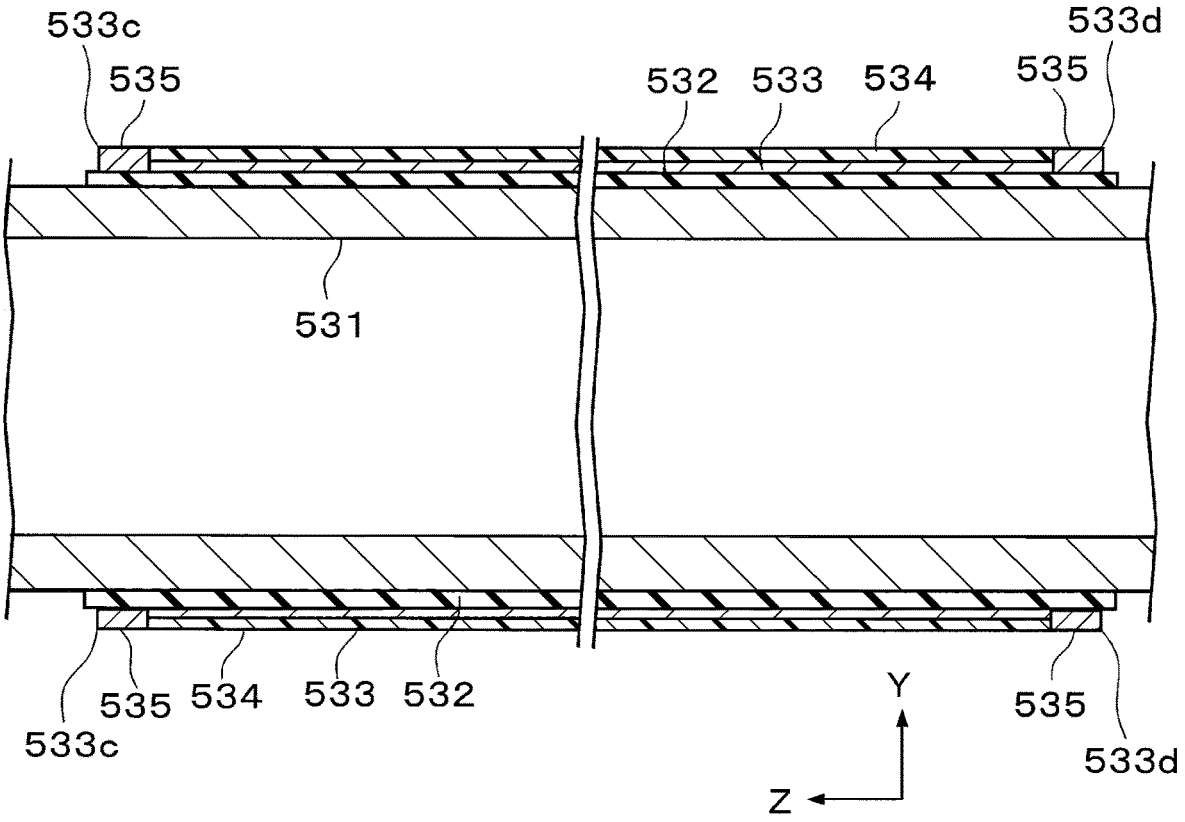

As illustrated in FIG. 4, the heating roller 53 is a roller body having a multilayer structure in which an electrical insulating layer 532, a resistance heat-generating layer 533 that generates heat by passage of a current therethrough, and a surface layer 534 are provided in this order on the outer peripheral surface of a cylindrical roller base member 531.

The roller base member 531 is a cylindrical body that is made of a metal material such as aluminum or iron and that has a thickness of about 0.2 to about 1.0 mm. The electrical insulating layer 532 is an insulating film made of a material such as a polyimide or polyether ether ketone (PEEK) that has an insulating property.

The resistance heat-generating layer 533 is a layer that generates heat by passage of a current therethrough and is a layer or a film that is made of a material such as silver palladium, gold palladium, or a mixture of carbon and a metal filler. The resistance heat-generating layer 533 is formed by, for example, a die-casting application technique from the standpoint of making the resistance heat-generating layer 533 to have a uniform layer thickness or the like. In addition, power is supplied to the resistance heat-generating layer 533 via electrode layers 535 formed at the two ends of the roller in the axial direction of the roller.

The surface layer 534 is a layer that has favorable thermal conductivity and that is capable of protecting the resistance heat-generating layer 533. In addition, the surface layer 534 may be a layer having tackiness for transmitting a rotational power to the fixing belt 55 and wettability with respect to a lubricating material, which will be described later, and from this standpoint, the surface layer 534 is made of a material having low releasability (e.g., a polyimide, polyether ether ketone (PEEK), or the like).

As illustrated in FIG. 3, the two end portions of the roller base member 531 are attached to upper side surface portions of the housing 50 with bearings 65 interposed therebetween such that the heating roller 53 is rotatable.

In addition, in the heating roller 53, power supply connectors 58A and 58B are attached to shaft portions that are formed of the two end portions of the roller base member 531 projecting toward the outside of the bearings 65. The power supply connectors 58A and 58B include power supply rings (not illustrated) that are arranged inside cylindrical insulating covers, and these power supply rings are electrically connected to the electrode layers 535, which are formed on the two end portions of the heating roller 53. The power supply connectors 58A and 58B are connected to a power supply unit 17, and when heating is required, a required current is supplied to the power supply connectors 58A and 58B from the power supply unit 17.

The fixing belt 55 is heated by the heating roller 53, and in the fixing treatment portion FN, the fixing belt 55 comes into contact with a surface of one of the recording media 9A to which the toner images 92 have been transferred and heats the surface. As the fixing belt 55, a flexible, heat-resistant endless belt for heat conduction is used, and an example of such a belt is a belt having a layered structure in which an elastic layer made of an elastic material, such as a silicone rubber, and a release layer made of a resin material, such as polytetrafluoroethylene (PTFE), are formed in this order on the outer peripheral surface of a cylindrical belt base member made of a synthetic resin, such as a polyimide or polyamide.

In addition, as illustrated in FIG. 2, the fixing belt 55 rotates in a direction indicated by arrow C while being stretched by the support member 54 and the adjustment support roller 56.

The support member 54 is a member that is disposed in such a manner as to be in contact with the inner peripheral surface of the fixing belt 55 and that supports and forms the fixing treatment portion FN in which the heating treatment is performed. The fixing treatment portion FN is a treatment portion for heating and fixing that is formed at a portion of the outer peripheral surface of the fixing belt 55, the portion being supported by the support member 54. The support member 54 is a structure formed of a plate-shaped support that has a hollow structure and that is disposed in such a manner as to extend parallel to the axial direction of the heating roller 53 and a pad member that is attached to a surface portion of the support, the surface portion being in contact with the inner peripheral surface of the fixing belt 55.

In addition, the support member 54 is positioned by fixedly attaching two end portions of the support that protrude from the two ends of the fixing belt 55 to, for example, side surface portions of the housing 50.

The adjustment support roller 56 is a roller that holds the fixing belt 55, which in the stretched state, in a desired shape by exerting a required tension on the fixing belt 55 and performs adjustment for stabilizing the rotating state of the fixing belt 55.

As illustrated in FIG. 2, the heating unit 52 further includes a lubricating-material application unit 57 that applies the lubricating material to the inner peripheral surface of the fixing belt 55 and a temperature sensor 59 that measures the surface temperature of the heating roller 53.

In addition, as illustrated in FIG. 3, in the heating unit 52, a plurality of temperature sensors 59*a* to 59*d* are arranged at predetermined positions (e.g., in opposite end regions and in a central region) in the axial direction of the heating roller 53 so as to measure surface temperatures of the heating roller 53 in a plurality of regions, and the heating unit 52 transmits the measurement results to a control device 15. The control device 15 controls the output operation or the like of the power supply device 17 so as to adjust the heating state.

In contrast, as illustrated in FIG. 2, the pressure roller 62 is a roller body having a structure in which an elastic release layer 622 is provided on the outer peripheral surface of a roller base member 621 that has a columnar shape or a cylindrical shape.

As illustrated in FIG. 2, the pressure roller 62 is attached to lower side surfaces of the housing 50 with bearings 66 interposed therebetween so as to be rotatable at a position where the pressure roller 62 faces the support member 54, the bearings 66 being attached to shaft portions 623 that protrude from the two ends of the roller base member 621. In addition, the bearings 66 are attached to the pressure roller 62 in such a manner as to be displaceable in directions toward and away from the support member 54, and a predetermined pressure in a direction toward the support member 54 is applied to the bearings 66 by urging members (not illustrated) such as springs. As a result, the fixing belt 55 passes through (the pad member of) the support member 54 while being pressed against (the pad member of) the support member 54 with a predetermined pressure.

In the fixing device 5A, when it is time to perform the fixing treatment or the like, the resistance heat-generating layer 533 of the heating roller 53 in the heating unit 52 generates heat by passage of a current therethrough and starts heating the heating roller 53 such that the heating roller 53 is kept at a predetermined temperature. In addition, the pressure roller 62 rotates in a direction indicated by arrow B, and the fixing belt 55 rotates in the direction indicated by arrow C.

As a result, the fixing belt 55 rotates in such a manner as to pass through the fixing treatment portion FN while being heated by the heating roller 53, and the fixing device 5A becomes capable of performing the fixing treatment.

In addition, as illustrated in FIG. 3, the fixing device 5A employs a configuration in which a power receiving component 67 that receives a rotational power that is transmitted at the timing at which the fixing treatment or the like is performed is not mounted on the heating roller 53.

As a result, in the fixing device 5A, asymmetric and uneven distribution of temperature in the heating roller 53 in the axial direction of the heating roller 53 is suppressed.

In contrast, in the case where the power receiving component 67, a representative example of which is a metal gear 67A, is attached to one end portion of the heating roller 53 (inn practice, the roller base member 531 or the shaft portions), heat dissipation in the one end portion of the heating roller 53 is accelerated by the influence of the heat capacity of the gear 67A serving as the power receiving component 67, and the surface temperature is reduced, and this may sometimes cause asymmetric and uneven distribution of temperature in the heating roller 53 in the axial direction. In other words, in this case, regarding the distribution of the surface temperature of the heating roller 53 in the axial direction when a heat-generating region is heated as a result of the resistance heat-generating layer 533 of the heating roller 53 generating heat, the surface temperature in the heat-generating region near the one end portion to which the power receiving component 67 is attached becomes relatively lower than the surface temperature in the heat-generating region near the other end portion.

However, in the fixing device 5A, the heating roller 53 is not influenced by the heat capacity of the power receiving component 67, and thus, the above-mentioned asymmetric and uneven distribution of temperature that is generated in the case where the power receiving component 67 is attached to the one end portion of the heating roller 53 is suppressed.

In addition, such asymmetric and uneven distribution of temperature may induce asymmetric and uneven fixing, and accordingly, such asymmetric and uneven fixing is also suppressed from being generated.

Since the fixing device 5A employs the above-described configuration for the power receiving component 67, the gear 67A serving as the power receiving component 67 is attached to one of the shaft portions 623 of the pressure roller 62 as illustrated in FIG. 3. The one shaft portion 623 is located on the far side in the apparatus depth direction Z.

A rotational power from a driving device (not illustrated) that is disposed in the housing 10 of the image forming apparatus 1A is transmitted to the gear 67A serving as the power receiving component 67, which is attached to one end portion of the pressure roller 62, via a final transmission gear 18.

Thus, in the fixing device 5A, when it is time to perform the fixing treatment or the like, as illustrated in FIG. 2 as an example, the pressure roller 62 is driven so as to rotate in the direction indicated by arrow B, and a rotational force of the pressure roller 62 is transmitted to the fixing belt 55, which is in contact with the pressure roller 62 in the fixing treatment portion FN, so that the fixing belt 55 is driven so as to rotate in the direction indicated by arrow C.

Figure 5A:
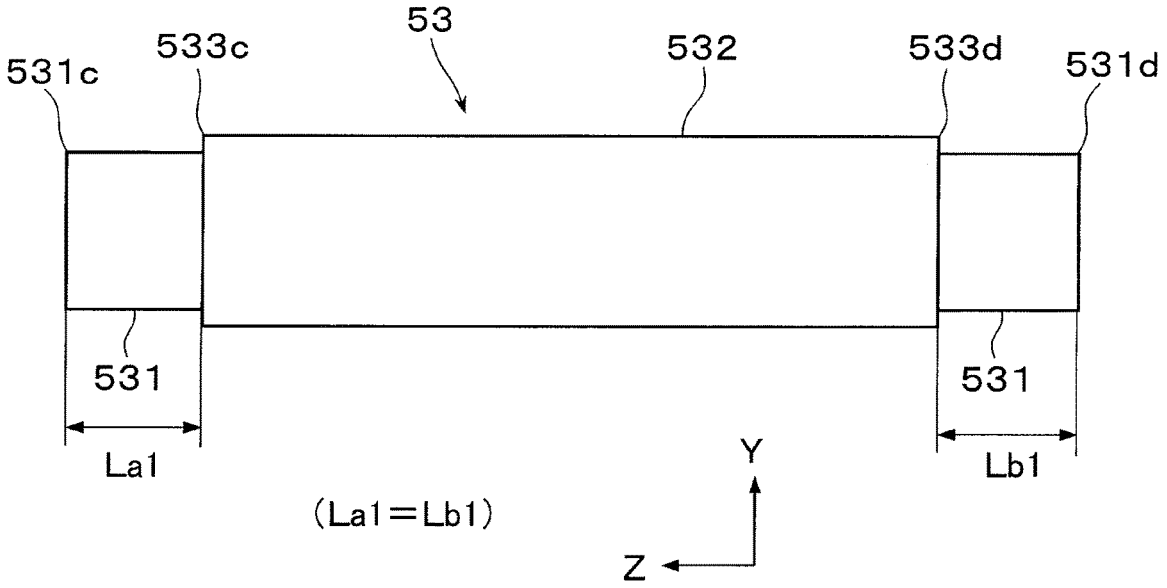
FIG. 5A and FIG. 5B are respectively a schematic diagram illustrating a portion of the heating roller and a schematic diagram illustrating a heating roller for comparison.

In addition, in the fixing device 5A, as illustrated in FIG. 5A, the resistance heat-generating layer 533 is provided in such a manner that, in the axial direction of the heating roller 53 (the longitudinal direction), a distance La1 from one end 533*c* of the resistance heat-generating layer 533 to one end 531*c* of the roller base member 531 and a distance Lb1 from the other end 533*d* of the resistance heat-generating layer 533 to the other end 531*d* of the roller base member 531 are equal to each other (La1=Lb1).

Figure 5B:
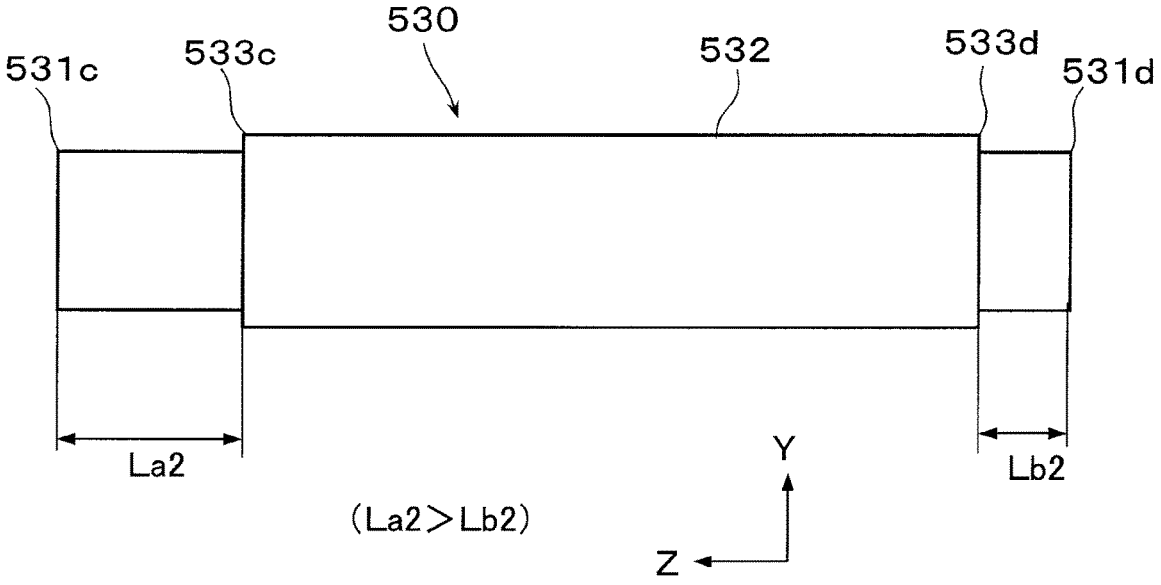

As a result, in the fixing device 5A, compared with a heating roller 530 that is illustrated in FIG. 5B as an example and that has the resistance heat-generating layer 533 provided in such a manner that, in the axial direction of the heating roller 530, a distance La2 from the end 533*c* of the resistance heat-generating layer 533 to the end 531*c* of the roller base member 531 and a distance Lb2 from the end 533*d* of the resistance heat-generating layer 533 to the end 531*d* of the roller base member 531 are different from each other (e.g., La2>Lb2), the heat dissipation amount at the two end portions of the roller base member 531, on each of which the resistance heat-generating layer 533 is not provided, is approximately the same, and thus, this makes it easier to suppress the above-mentioned asymmetric and uneven distribution of temperature in the axial direction of the heating roller 53.

Second Exemplary Embodiment

Figure 6:
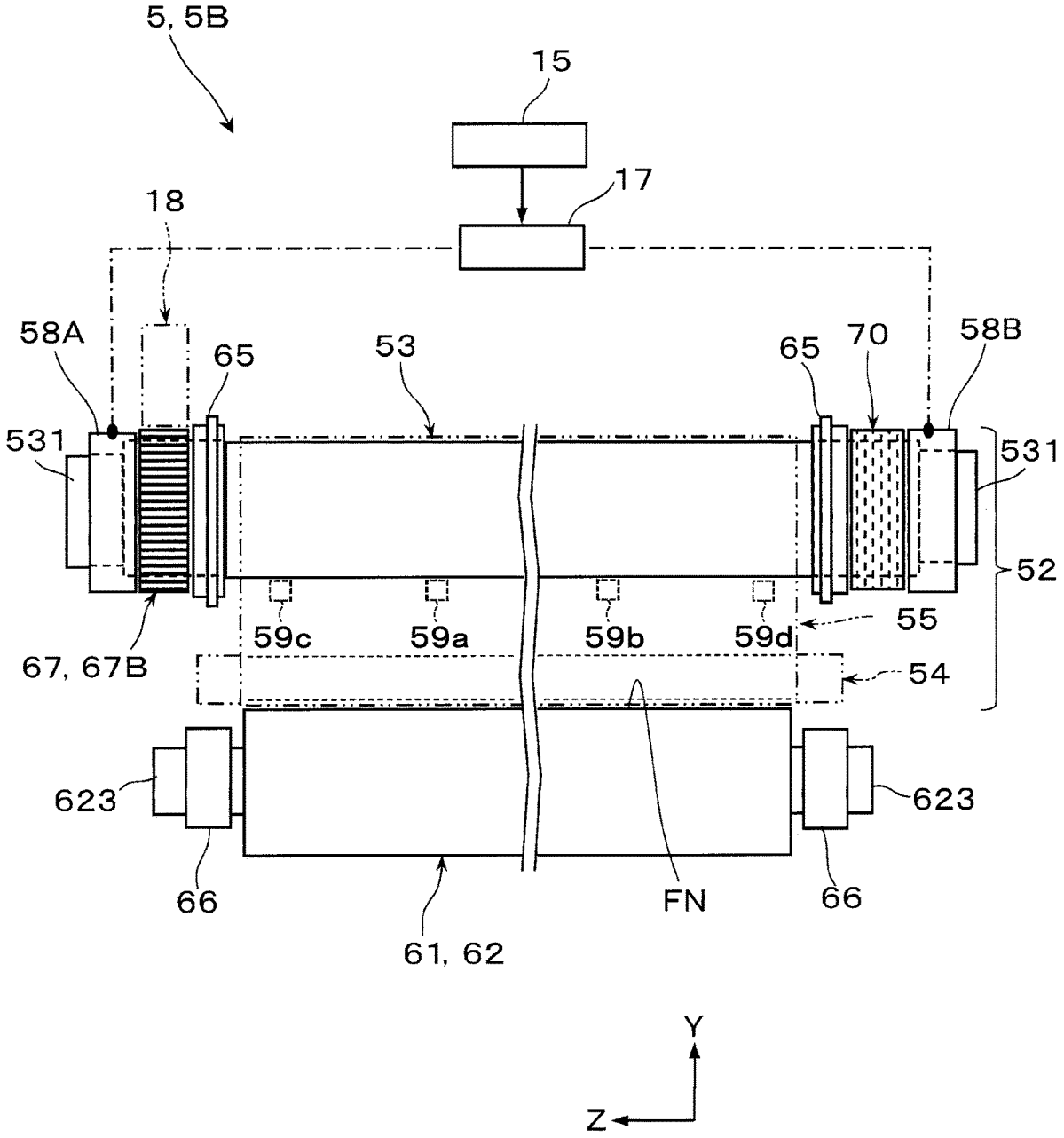
FIG. 6 is a schematic diagram of a fixing device according to a second exemplary embodiment, which is another example of the heating device.

FIG. 6 illustrates a fixing device 5B according to the second exemplary embodiment, which is another example of the heating device 5.

The fixing device 5B according to the second exemplary embodiment is different from the fixing device 5A according to the first exemplary embodiment in that the power receiving component 67 is attached to one end portion of the heating roller 53 and in that a complementary component 70 that has a heat capacity approximately equal to that of the power receiving component 67 is attached to the other end portion of the heating roller 53. The configuration of the fixing device 5B excluding the above, is the same as that of the fixing device 5A. Accordingly, in the following description and the drawings, components that are common to the first exemplary embodiment are denoted by the same reference signs used in the first exemplary embodiment, and descriptions of the components will be omitted unless necessary.

As illustrated in FIG. 6, in the fixing device 5B, a gear 67B that serves as the power receiving component 67 is attached to one end portion of the roller base member 531 that corresponds to one end portion of the heating roller 53 and that is located on the far side. More specifically, the gear 67B is attached to the far-side end portion of the roller base member 531 in such a manner as to be positioned between one of the bearing 65 and the power supply connector 58A.

A rotational power from a driving device (not illustrated) that is disposed in the housing 10 of the image forming apparatus 1A is transmitted to the gear 67B serving as the power receiving component 67, which is attached to one end of the heating roller 53, via the final transmission gear 18.

In addition, in the fixing device 5B, as illustrated in FIG. 6, the complementary component 70 having a heat capacity approximately equal to the heat capacity of the gear 67B is attached to the other end portion of the roller base member 531 that corresponds to the other end portion of the heating roller 53 and that is located on the near side. As the complementary component 70, a member that is made of the same material and that has the same shape as the power receiving component 67, such as the gear 67B, may be used. In addition, similar to the gear 67B, the complementary component 70 is attached to the near-side end portion of the roller base member 531 in such a manner as to be positioned between one of the bearing 65 and the power supply connector 58B.

In the fixing device 5B, when it is time to perform the fixing treatment or the like, the resistance heat-generating layer 533 of the heating roller 53 in the heating unit 52 generates heat by passage of a current therethrough and starts heating the heating roller 53 such that the heating roller 53 is kept at a predetermined temperature, and in addition, the heating roller 53 starts rotating in the direction indicated by arrow C, so that the fixing belt 55 also rotates in the direction indicated by arrow C. Then, a rotational force of the fixing belt 55 is transmitted to the pressure roller 62 in the fixing treatment portion FN, and the pressure roller 62 is driven so as to start rotating in the direction indicated by arrow B.

As a result, the fixing belt 55 rotates in such a manner as to pass through the fixing treatment portion FN while receiving a rotational driving force from the heating roller 53A and also being heated by the heating roller 53A, and the fixing device 5B becomes capable of performing the fixing treatment.

In addition, in the fixing device 5B, although heat dissipation in the one end portion of the roller base member 531 of the heating roller 53, to which the gear 67B serving as the power receiving component 67 is attached, is accelerated by the influence of the heat capacity of the gear 67B, and the surface temperature is reduced, the complementary component 70 is attached to the other end portion of the roller base member 531, which corresponds to the other end portion of the heating roller 53, and thus, heat dissipation in the other end portion is accelerated by the influence of the heat capacity of the complementary component 70, and the surface temperature is reduced. As a result, uneven distribution of temperature in the axial direction of the heating roller 53 becomes approximately uniform.

In addition, as in the fixing device 5A according to the first exemplary embodiment, in the fixing device 5B, the resistance heat-generating layer 533 is provided in such a manner that, in the axial direction of the heating roller 53, the distance La1 from the end 533*c* of the resistance heat-generating layer 533 to the end 531*c* of the roller base member 531 and the distance Lb1 from the end 533*d* of the resistance heat-generating layer 533 to the end 531*d* of the roller base member 531 are equal to each other (see FIG. 5A). This makes it easier to suppress the above-mentioned asymmetric and uneven distribution of temperature in the axial direction of the heating roller 53 in the fixing device 5B for the same reason as in the case of the fixing device 5A according to the first exemplary embodiment.

Thus, in the fixing device 5B, the above-mentioned asymmetric and uneven distribution of temperature in the axial direction of the heating roller 53 is suppressed, whereas in the case where the complementary component 70 having a heat capacity approximately equal to that of the power receiving component 67 is not attached to the heating roller 53, the above-mentioned asymmetric and uneven distribution of temperature in the axial direction of the heating roller 53 is not suppressed.

In addition, in the fixing device 5B, although in the case where there is asymmetric and uneven distribution of temperature in the heating roller 53, the asymmetric and uneven distribution of temperature may induce asymmetric and uneven fixing, such asymmetric and uneven fixing is also suppressed from being generated.

Third Exemplary Embodiment

Figure 7:
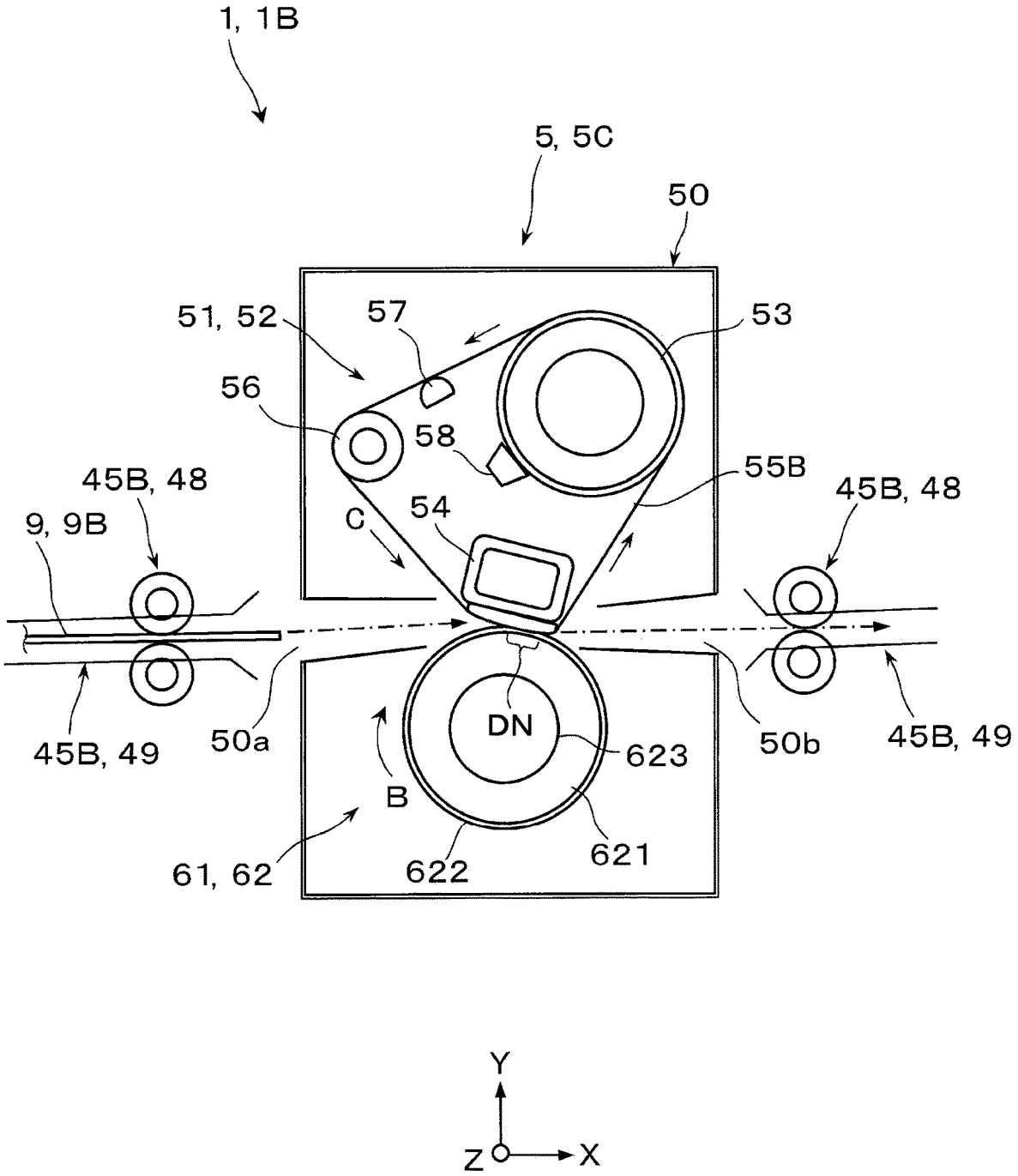
FIG. 7 is a schematic diagram illustrating a heating device according to a third exemplary embodiment and a heating-and-drying apparatus according to the third exemplary embodiment, which is another example of a heating-target using apparatus.

FIG. 7 illustrates a heating device 5C according to the third exemplary embodiment that is another example of the heating device 5 and a heating-and-drying apparatus 1B according to the third exemplary embodiment that uses the heating device 5C and that is another example of the heating-target using apparatus 1.

The heating device 5C according to the third exemplary embodiment is different from the fixing device 5A according to the first exemplary embodiment and the fixing device 5B according to the second exemplary embodiment in that the fixing belt 55 is changed to a heating belt 55B. The configuration of the heating device 5C excluding the above, is the same as the configuration of the heating device 5A and the configuration of the fixing device 5B. Accordingly, in the following description and the drawings, components that are common to these devices are denoted by the same reference signs used in the first exemplary embodiment, and descriptions of the components will be omitted unless necessary.

In the heating device 5C, a belt having favorable thermal conductivity is used as the heating belt 55B, and for example, a belt that is formed of a cylindrical belt base member made of a synthetic resin such as a polyimide or polyamide is used. Note that, the above-mentioned fixing belt 55 may be used as the heating belt 55B.

In addition, in the heating device 5C, a portion in which a portion of the heating belt 55B that is supported by the support member 54 and the pressure roller 62 are pressed into contact with each other is configured as a drying treatment portion DN in which heating and drying treatments are performed.

The heating-and-drying apparatus 1B using the heating device 5C includes a sheet transport device 45B that transports a sheet-shaped object 9B that requires heating and drying as the heating target 9 in such a manner that the sheet-shaped object 9B is introduced into and passes through the drying treatment portion DN of the heating device 5C. The sheet transport device 45B includes pairs of transport rollers 48, guide members 49, and so forth. Examples of the sheet-shaped object 9B include the above-mentioned recording media 9A.

Also in the heating device 5C, asymmetric and uneven distribution of temperature in the heating roller 53 in the axial direction is suppressed from being generated. Consequently, heating and drying are suppressed from becoming asymmetric and uneven due to such asymmetric and uneven distribution of temperature.

Modifications

The present disclosure is not limited to the configuration examples that have been described as examples in the above exemplary embodiments, and for example, the present disclosure also includes modifications such as those described below.

In the above-described fixing devices 5A, 5B, and 5C, the adjustment support roller 56 of the heating unit 52 does not need to be provided. In addition, for example, a belt-nip-type pressure rotating body may be used as the pressure rotating body 61 instead of the pressure roller 62 having a roll-like shape. Furthermore, the power receiving component 67 may be, for example, a pulley that receives a timing belt for drive transmission.

In the first exemplary embodiment and the like, although a configuration example in which the image forming apparatus 1A forms a monochromatic image has been described, the image forming apparatus 1A may be an apparatus that forms a polychromatic image by combining toners of a plurality of colors, and the format and so forth are not particularly limited.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A heating device comprising:

a heating roller having a resistance heat-generating layer that generates heat by passage of a current through the resistance heat-generating layer;

a support member that supports a treatment portion in which a heating treatment is performed;

a belt that is stretched between at least the heating roller and the support member and that rotates; and a pressure rotating body that rotates in such a manner as to press a sheet-shaped heating target that is an object to be subjected to a heating treatment against the treatment portion including an outer peripheral surface portion of the belt that is supported by the support member and in such a manner as to cause the heating target to pass through the treatment portion, wherein the heating roller is not equipped with a power receiving component configured to receive a rotational power that is transmitted, and wherein the resistance heat-generating layer is provided in such a manner that, in an axial direction of the heating roller, a distance from one of two ends of the resistance heat-generating layer to one of two ends of the heating roller and a distance from another one of the two ends of the resistance heat-generating layer to another one of the two ends of the heating roller are equal to each other.

2. The heating device according to claim 1, wherein the pressure rotating body is equipped with the power receiving component.

3. The heating device according to claim 1, further comprising:

a support roller that supports the belt from a space enclosed by the belt and that is equipped with the power receiving component.

4. A heating device comprising:

a heating roller having a resistance heat-generating layer that generates heat by passage of a current through the resistance heat-generating layer;

a support member that supports a treatment portion in which a heating treatment is performed;

a belt that is stretched between at least the heating roller and the support member and that rotates; and a pressure rotating body that rotates in such a manner as to press a heating target that is an object to be subjected to a heating treatment against the treatment portion including an outer peripheral surface portion of the belt that is supported by the support member and in such a manner as to cause the heating target to pass through the treatment portion, wherein a power receiving component configured to receive a rotational power that is transmitted is attached to one end portion of the heating roller in a longitudinal direction, and a complementary component having a heat capacity approximately equal to a heat capacity of the power receiving component is attached to another end portion of the heating roller in the longitudinal direction.

5. The heating device according to claim 4, wherein the resistance heat-generating layer is provided in such a manner that, in an axial direction of the heating roller, a distance from one of two ends of the resistance heat-generating layer to one of two ends of the heating roller and a distance from another one of the two ends of the resistance heat-generating layer to another one of the two ends of the heating roller are equal to each other.

6. A heating-target using apparatus comprising:

a transport unit that transports a sheet-shaped heating target that is an object to be heated; and a heating device that heats the heating target transported by the transport unit, wherein the heating device is formed of the heating device according to claim 1.

7. The heating-target using apparatus according to claim 6, wherein the heating device is a fixing device that fixes an unfixed image onto a recording medium, which is the sheet-shaped heating target.

8. A heating-target using apparatus comprising:

a transport unit that transports a sheet-shaped heating target that is an object to be heated; and a heating device that heats the heating target transported by the transport unit, wherein the heating device is formed of the heating device according to claim 4.

9. The heating-target using apparatus according to claim 8, wherein the heating device is a fixing device that fixes an unfixed image onto a recording medium, which is the sheet-shaped heating target.

* * * * *